US008390530B2

(12) United States Patent
Werner et al.

(10) Patent No.: US 8,390,530 B2
(45) Date of Patent: Mar. 5, 2013

(54) METHOD AND APPARATUS FOR REDUCED COUPLING AND INTERFERENCE BETWEEN ANTENNAS

(75) Inventors: Douglas H. Werner, State College, PA (US); Do-Hoon Kwon, Amherst, MA (US)

(73) Assignee: The Penn State Research Foundation, University Park, PA (US)

( * ) Notice: Subject to any disclaimer, the term of this patent is extended or adjusted under 35 U.S.C. 154(b) by 788 days.

(21) Appl. No.: 12/367,196

(22) Filed: Feb. 6, 2009

(65) Prior Publication Data

US 2009/0201221 A1 Aug. 13, 2009

Related U.S. Application Data

(60) Provisional application No. 61/026,880, filed on Feb. 7, 2008.

(51) Int. Cl.

| | |
|---|---|
| ***H01Q 15/02*** | (2006.01) |
| ***H01Q 1/52*** | (2006.01) |
| ***H01Q 21/00*** | (2006.01) |
| ***H01Q 1/42*** | (2006.01) |

(52) U.S. Cl. ..... 343/909; 343/841; 343/893; 343/872

(58) Field of Classification Search ..... 343/753, 343/754, 756, 757, 700 MS, 909, 844
See application file for complete search history.

(56) References Cited

U.S. PATENT DOCUMENTS

| | | | | |
|---|---|---|---|---|
| 6,870,517 | B1 * | 3/2005 | Anderson | 343/909 |
| 7,348,930 | B2 * | 3/2008 | Lastinger et al. | 343/844 |
| 7,629,941 | B2 * | 12/2009 | Pendry et al. | 343/851 |
| 7,795,596 | B2 * | 9/2010 | Chowdhury | 250/393 |
| 2006/0232479 | A1 * | 10/2006 | Walton | 343/700 MS |
| 2007/0085757 | A1 * | 4/2007 | Sievenpiper | 343/909 |
| 2008/0024792 | A1 | 1/2008 | Pendry et al. | |
| 2008/0165442 | A1 * | 7/2008 | Cai et al. | 359/896 |
| 2009/0058751 | A1 * | 3/2009 | Suh et al. | 343/795 |
| 2010/0277381 | A1 * | 11/2010 | Smolyaninov et al. | 343/713 |

FOREIGN PATENT DOCUMENTS

| | | |
|---|---|---|
| JP | 2006258449 A | 9/2006 |
| WO | WO-03036758 | 5/2003 |
| WO | WO-2006023195 | 3/2006 |

OTHER PUBLICATIONS

V. Varadan, S. Puligalla, A.R. Tellakula, "Experimental Demonstration of Cloaking by Metamaterials," IEEE Antennas and Propagation Society International Symposium 2007, Jun. 9-15, 2007, Honolulu, HI, pp. 1173-1176.

(Continued)

*Primary Examiner* — Jacob Y Choi
*Assistant Examiner* — Hasan Islam
(74) *Attorney, Agent, or Firm* — Gifford, Krass, Sprinkle, Anderson & Citkowski, P.C.

(57) ABSTRACT

Examples of the present invention include antennas and scattering elements having a metamaterial cloak configured so as to reduce effects on the operating parameters of a nearby antenna. For example, an antenna has an antenna frequency, and a cloak is disposed around the antenna having a frequency range in which the cloak is operative. The antenna frequency can lie outside the frequency range of the cloak, whereas the frequency of a second antenna lies within the frequency range of the cloak. In this case, the antenna is cloaked relative to the second antenna.

13 Claims, 5 Drawing Sheets

OTHER PUBLICATIONS

F.L. Teixeira, "Closed-Form Metamaterial Blueprints for Electromagnetic Masking of Arbitrarily Shaped Convex PEC Objects," IEEE Antennas and Wireless Propagation Letters, vol. 6, 2007, pp. 163-164.

Do-Hoon Kwon, Douglas H. Werner, "Shielding of Antenna Parameters in Scattering Environments Using Electromagnetic Cloaking," Antennas and Propagation Society International Symposium, IEEE Jul. 5-11, 2008, pp. 1-4.

Graeme W. Milton, Marc Briane, John R. Willis, "On cloaking for elasticity and physical equations with a transformation invariant form," New Journal of Physics, vol. 8 (2006) 248, pp. 1-20.

J.B. Pendry, D. Schurig, D.R. Smith, "Controlling Electromagnetic Fields," Science, vol. 312, Jun. 23, 2006, pp. 1780-1782.

* cited by examiner

METHOD AND APPARATUS FOR REDUCED COUPLING AND INTERFERENCE BETWEEN ANTENNAS

REFERENCE TO RELATED APPLICATION

This application claims priority to U.S. Provisional Patent Application Ser. No. 61/026,880, filed Feb. 7, 2008, the entire contents of which are incorporated herein by reference.

GRANT REFERENCE

This invention was made with government support under Grant No. DMR-0213623 awarded by the National Science Foundation (NSF). The government has certain rights in the invention.

FIELD OF THE INVENTION

The invention relates to antennas, in particular to improvement of antenna performance.

BACKGROUND

Designing an antenna for operation near a large mounting structures or other antenna is a serious challenge. For antennas mounted on large platforms such as ships or aircraft, objects part of the host structure may cast deep shadows in the forward direction of the radiation patterns. Moreover, near-field mutual coupling effects can severely distort the electrical parameters for individual antennas radiating in multiple-antenna environments.

Hence, improved antenna configurations are urgently required.

SUMMARY OF THE INVENTION

In examples of the present invention, electromagnetic cloaks are used as shielding devices which enable improved antenna performance, particularly in highly scattering, multiple-antenna configurations. An antenna may be enclosed in an electromagnetic cloak (hereinafter "cloak"), such as a metamaterial or other dispersive material, which is designed to operate as a cloak at the transmitting frequency (and/or receiving frequency) of one or more neighboring antennas.

Further, the loading effect of an electromagnetic radiation scattering object ("scatterer") proximate to a radiating antenna can be reduced or eliminated by enclosing the scatterer with an electromagnetic cloak.

In some examples, application of cloaks to microwave antenna shielding may use narrowband cloaks, operable as an electromagnetic cloak at the operating frequency (or frequencies) of one or more proximate antennas. A cloak may comprise a metamaterial, and can be realized using currently available metamaterials. An example apparatus comprises an antenna, having an operating frequency, and an electromagnetic cloak disposed around the antenna, the electromagnetic cloak having a cloaking frequency range in which the electromagnetic cloak is operative to guide external radiation around the antenna, the electromagnetic cloak being substantially transparent at the operating frequency of the antenna.

BRIEF DESCRIPTION OF THE FIGURES

FIG. 1A shows antenna $A_1$ radiating at frequency $f_1$, and FIG. 1B $A_2$ radiating at frequency $f_2$, where solid boundaries for cloaks indicate perfect cloaking, and dashed boundaries indicate that the cloak parameters have free-space values.

FIG. 2A shows the antenna $A_1$ radiating in free space, FIG. 2B shows the antenna $A_1$ radiating in the presence of a 100 mm-long line-dipole antenna $A_2$ located 200 mm away, and FIG. 2C shows the antenna $A_2$ surrounded by an elliptic annular cloak $C_2$, substantially eliminating the effect of antenna $A_2$ on the field pattern of antenna $A_1$.

DETAILED DESCRIPTION

Figure 1A:
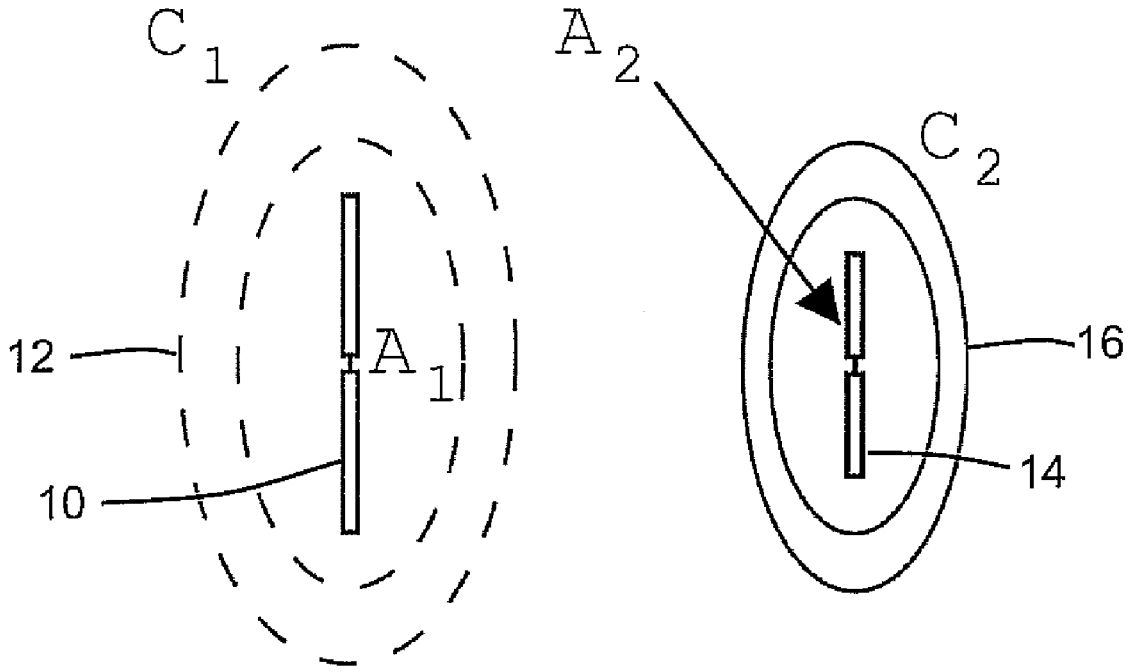
FIGS. 1A and 1B show radiation configuration involving two antennas $A_1$, $A_2$ and two cloaks $C_1$, $C_2$.

Examples of the present invention include methods and apparatus for reducing, and in some cases substantially eliminating, coupling and interference effects among multiple antenna elements located in proximity to each other. Shielding from interference is achieved by using electromagnetic cloaks, for example cloaks formed using a metamaterial. By enclosing individual antennas in properly designed electromagnetic cloaks, an antenna operating at one frequency does not present interference to other antennas operating at different frequencies. Moreover, an object in close proximity to an operating antenna can be cloaked so that it has no effect on either the near-field or far-field distribution of the antenna.

Applications include the mitigation of co-site interference, which typically occurs when multiple antennas are employed in a limited space. Wireless handsets may include several antennas to meet the requirements for one or more wireless communication standards. A ship or an aircraft may have numerous antennas mounted on the platform for navigational and tracking purposes. Other examples include any transmitter system having multiple antennas, or any electronic device having one or more antennas, which may be transmitting and/or receiving antennas.

An antenna operating in a multiple antenna environment, such as multi-standard wireless environment, operates in the presence of other antennas as well as the platform it is mounted upon. The interaction between the antenna and all other elements in the environment conventionally changes or significantly distorts the electrical performance relative to the performance obtained if a similar antenna operates alone, for example in free space or on a ground plane.

In many practical situations, it is desirable to obtain undistorted antenna parameters, such as distortions in the input impedance and/or radiation patterns, even when the antenna operates in the presence of other antennas or scattering objects. The effects of other antennas and platforms in the proximity of an antenna may be classified into categories such as distortion of the radiation pattern (e.g. directivity) and input impedance. Examples of the present invention allow reduction or substantial elimination of such distortions.

For example, the radiation pattern of an antenna may be distorted from its free-space pattern when other materials (including antennas or other conducting and non-conducting objects) are present in proximity to the antenna. If an electrically large and impenetrable scatterer is placed near a transmitting antenna, it casts a shadow in the forward scattering direction, reducing the signal strength considerably. Examples of the present invention include reduction or elimination of such blockage by a scatterer by cloaking of the scatterer. A scatterer may be a mounting component, other antenna, or any other object proximate the antenna. Similarly, reception properties of an antenna may be improved using a similar approach.

In conventional systems, mutual coupling between antenna elements chances the input impedance of each of the antennas, regardless of if the antennas are designed to operate in the same or different frequency bands. Examples of the present invention include cloaking of antennas, allowing antenna parameters to be obtained that are similar to those observed if the individual antennas were radiating in isolation. Hence, examples of the present invention allow reduction (in some cases substantial or complete elimination) of the pattern distortion and the impedance modification of an antenna, even when the antenna is proximate other elements that would conventionally cause appreciable effects.

Electromagnetic cloaks can be configured to bend incident waves smoothly around a cloaked object, such that the fields that emerge from the cloak are the same as if the incident waves just passed through the same region of free space. The problems of radiation pattern and input impedance distortion can be significantly mitigated or even completely removed using a cloak. Examples of the present invention allow multiple antennas operating at multiple frequency bands in close proximity to one another and/or placed near electrically large scattering objects to operate with undistorted radiation patterns and unperturbed input parameters.

Perfect electromagnetic cloaking can be obtained using ideal cloak parameters, for example those obtained using full-wave simulations or other approach. However, antenna performance can be improved with imperfect cloaking.

Desired cloaking material parameters may be obtained using metamaterials. Cloaking in the radar wavelengths has been previously demonstrated, and optical cloaking may be achieved for example using a metamaterial incorporating metallic nanowires.

Examples of the present invention include the use of electromagnetic cloaking in the shielding of an antenna's radiation and input parameters from the surrounding environment in which the antenna operates. Under ideal conditions, the degradation in an antenna's performance due to the presence of scatterers and/or other antennas in close proximity can be completely removed by using a properly designed electromagnetic cloak.

The near-field and far-field shielding effects of such cloaks are demonstrated using full-wave electromagnetic simulations of two-dimensional (2D) antenna and scatterer configurations. The 2D results presented here can be readily extended to three dimensions.

Shell-type electromagnetic cloaks using metamaterials are typically narrowband due to the dispersive nature of the metamaterial coatings. For application of cloaks to antenna shielding in the microwave regime, narrow-band cloaks may be desirable. In some examples, a cloak may have multiple bands of operation corresponding to different antenna operating frequencies within the environment.

An example antenna has an antenna frequency and a cloak disposed around the antenna, the cloak having a first frequency range in which the cloak is operative, and a second frequency range in which the cloak is inoperative, the antenna frequency lying within the second frequency range. The cloak may comprise a metamaterial.

An example antenna system comprises a plurality of antennas, including a first antenna having a first antenna frequency, a first cloak surrounding the first antenna having a first frequency range in which the first cloak is operative, a second antenna having a second operating frequency, and a second cloak surrounding the second antenna having a second frequency range in which the second cloak is operative. In examples of the present invention, the first antenna frequency is within the second frequency range, and the second antenna frequency is within the first frequency range. In some examples, the first antenna frequency is outside the first frequency range, and/or the second antenna frequency is outside the second frequency range.

Figure 1B:
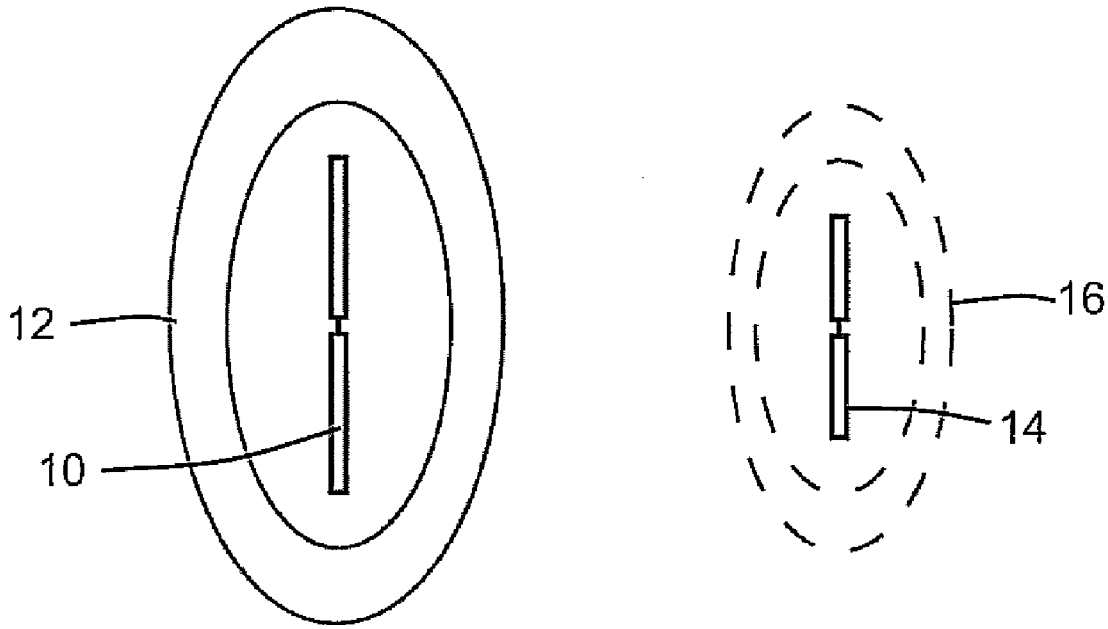

FIG. 1A-1B show an example configuration including two antennas and two cloaks. The first antenna 10 denoted Al has a cloak 12 denoted $C_1$, and the second antenna 14 denoted $A_2$ has a cloak 16 denoted $C_2$. The antenna $A_1$ operates at frequency $f_1$ and transmits and receives through cloak $C_1$, which can be designed to have free-space parameters at $f_1$ (i.e., $C_1$ is transparent at $f_1$). A nearby antenna $A_2$ is enclosed by cloak $C_2$, which is designed to cloak time-harmonic waves at frequency $f_1$. At the operating frequency $f_2$ of antenna $A_2$, the functions of the cloaks are reversed. In the figures, solid boundaries for cloaks indicate perfect cloaking, whereas dashed boundaries signify that the cloak parameters assume free-space values.

FIG. 1A corresponds to frequency $f_1$, and in this case the cloak $C_1$ is denoted with dashed lines, as at this frequency the cloak is effectively transparent and the parameters of the cloak material approximate those of free space. FIG. 1B corresponds to frequency $f_2$, and in this case the cloak $C_2$ is denoted with dashed lines as it is effectively transparent.

This general approach can be extended to an arbitrary number of antennas, for example in a multi-antenna system. Let there be N number of antennas operating at N different non-overlapping narrow frequency bands. The antennas and the associated frequencies of operation are denoted by $A_i$ and $f_1$ (i=1, 2, . . . , N). Then, let the antenna $A_i$ be enclosed in a cloak that operates at frequencies $f_j$ ($j \neq i$), but transparent at $f_i$ (the material parameters approximating to those of free space). Each antenna then will not be able to "see" the presence of all other antennas, and it will thus behave as if the other antennas were not present. Cloaked antennas may be placed not only in the far field of an antenna but also in the near field as well without creating any interference or coupling effects.

The material parameters of a cloak $C_i$ at frequency $f_i$ can be designed to reduce to free space values, allowing the cloak for a particular antenna to be transparent for that antenna's operating frequency. In this case, the cloak would be operating away from any resonance of its constituent metamaterials such that no significant loss is expected as antenna $A_i$ radiates through the cloak $C_i$.

For shielding applications involving a collection of narrowband antennas, the cloaks only need to be narrowband in the case of two antennas and multi-band for more than two antennas. Metamaterial cloaks are typically dispersive, so narrowband or multi-band metamaterial cloaks are easier to fabricate than applications which require broadband/wideband cloaking.

For electromagnetic simulations, 2D line-dipole antennas and cloaks were employed and full-wave finite element simulations using COMSOL Multiphysics were used to investigate the effects of various cloaked radiation and scattering configurations. A line-dipole antenna is the time-harmonic equivalent of a pair of closely-spaced 2D line charges in electrostatics. Two thin strips, which are infinite in the $\pm\hat{z}$ directions, form the arms of the line-dipole. The antenna is excited by a voltage or current source placed at its center, which is also assumed to be infinite in extent. In such a radiation configuration, the electric field vector is contained in the x-y plane and the magnetic field is ˆz-directed.

To investigate the shielding effect of cloaks applied to multiple antennas, a configuration of two antennas operating at two different frequency bands in the proximity of each other was considered. For the purpose of theoretical comparison, wideband cloak parameters are assumed.

Simulations were performed for a 75 mm long source radiating alone in free space, near a 50 mm-long dipole (unexcited) separated by 200 mm, and a 75 mm long dipole radiating with the 50 mm-long dipole cloaked. The shielding effect of the cloaked second source on the far-field radiation of the original 75 mm long line-dipole antenna was observed using the observed radiation patterns, and was seen to be substantially eliminated when the second antenna was cloaked. Further, the associated far-field directivity patterns coincided when the 75 mm-long dipole radiates alone in free space and when the 50 mm-long dipole antenna at the distance of 200 mm was enclosed in a cloak operating at 2 GHz, but transparent at 3 GHz. In contrast, the radiation pattern of the original antenna in the presence of the second antenna is distorted. Input admittances were compared, and the input admittances per unit length (in the $\hat{z}$-direction) observed at the terminals of the 75 mm long source were the same for the first antenna in free space and the second antenna cloaked. The admittance of the 75 mm long antenna when radiating in proximity to an uncloaked second source oscillates and deviates from free space and cloaked cases, which typically indicates strong near-field coupling between two antennas.

Figure 2A:
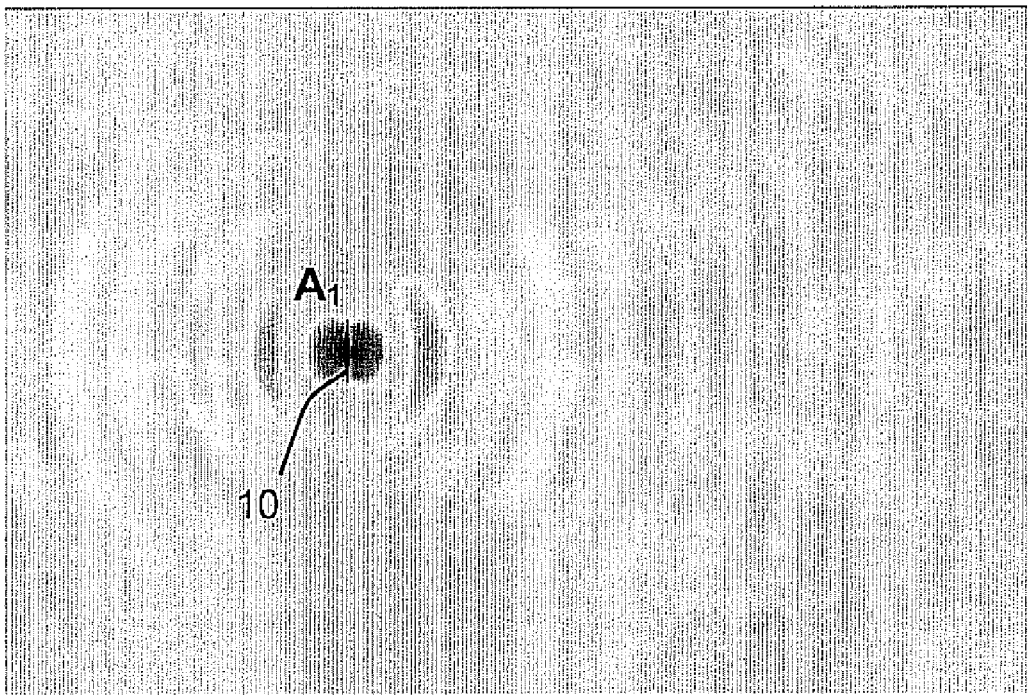
FIGS. 2A-2C show the total magnetic field distribution due to a 75 mm long line-dipole antenna $A_1$.

FIG. 2A shows the total magnetic field directed in the $\hat{z}$-direction from a first antenna 10, denoted $A_1$. In this example, the antenna is two-dimensional line-dipole antenna of length 75 mm operating at 2 GHz, and is radiating alone in free space. Similar to a three-dimensional wire dipole antenna, there are pattern nulls in the two directions of the line-dipole arms and the pattern maximum is in the directional normal to the plane of the arms.

Figure 2B:
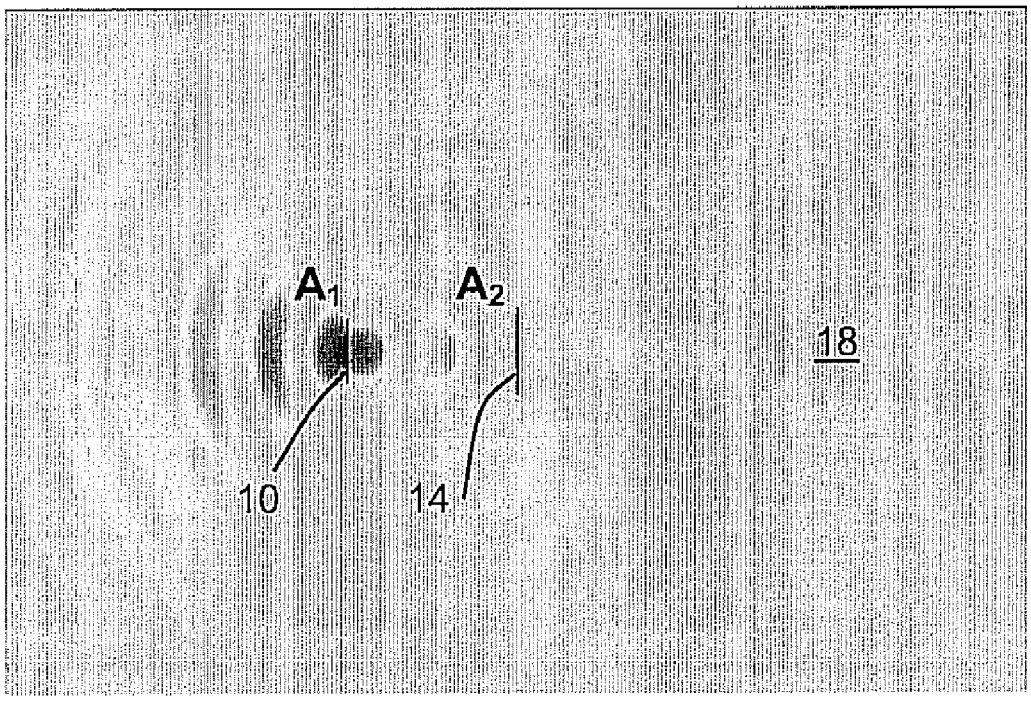

FIG. 2B shows a second antenna 14, denoted $A_2$, placed proximate first antenna. In this example, the second antenna is a line dipole of 50 mm length, has an operating frequency of 3 GHz, and is placed at a distance of 200 mm from the first antenna 10. FIG. 2B shows that the field radiated by the first antenna is distorted by the presence of the second antenna. The second antenna is not excited at 2 GHz, and acts only as a scatterer. There is a shadow region 18 within the radiation field of the first antenna which is significantly distorted by the presence of the second antenna.

Figure 2C:
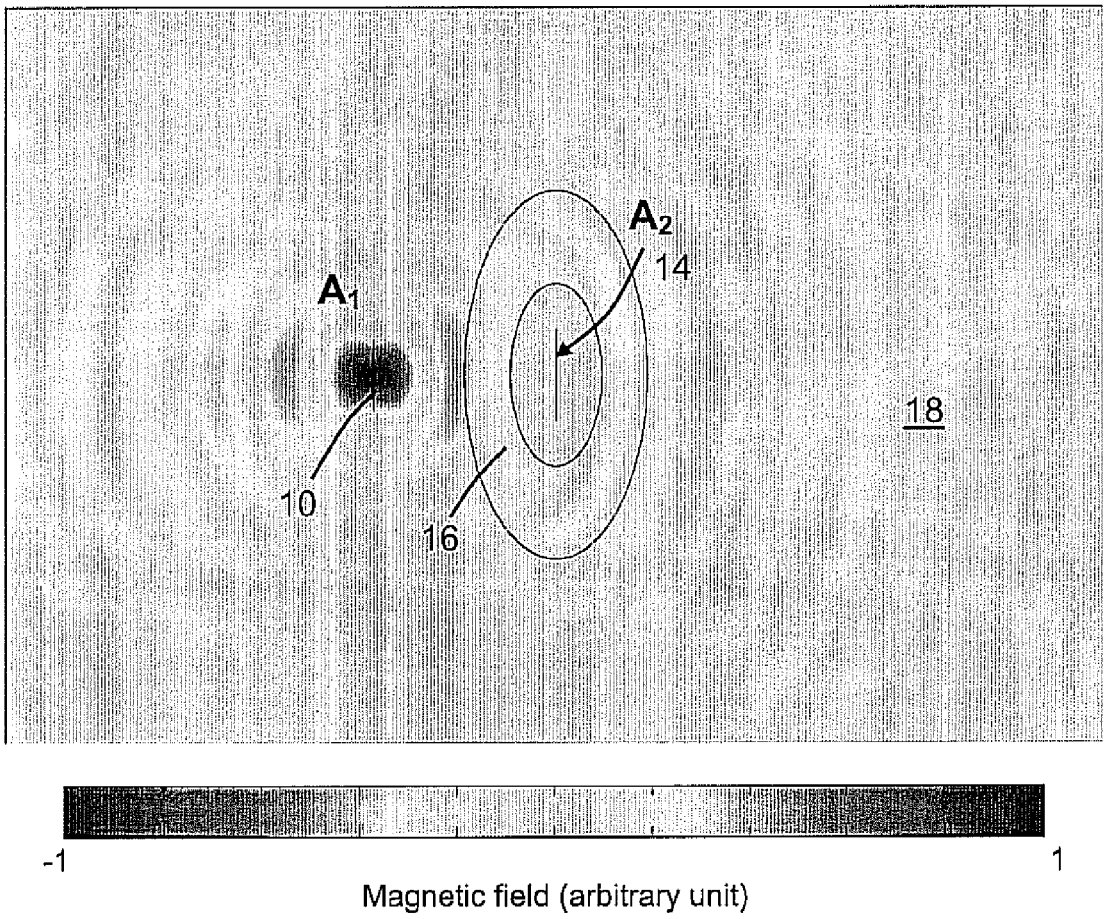

FIG. 2C shows a configuration where the second antenna (the 50 mm long dipole antenna) is covered by an elliptic annular cloak 16, and the inner and outer boundaries of the cloak 16 are indicated by solid contours. This simulation corresponds to a representative example of the configuration illustrated by FIG. 1A. Outside the cloak region, the total field distribution in FIG. 2C is the same as for the undisturbed free-space radiation shown in FIG. 2A. This improvement is particularly visible in the shadow region 18.

When the antenna Al radiates in the presence of the unexcited antenna $A_2$ directed parallel to $A_1$ as shown in FIG. 2B, the near field $A_1$ is perturbed and scattered by $A_2$. However, when antenna $A_2$ is enclosed by an elliptic annular cloak denoted by $C_2$, the scattering effects of the second antenna are appreciably reduced. FIG. 2C demonstrates that the time-harmonic fields at 2 GHz are smoothly guided around $A_2$ by $C_2$ and the near field distribution is restored to what it was in FIG. 2A.

The inner and outer boundaries of the elliptic cloak $C_2$ are indicated by the black contours which appear in FIG. 2C. In this example, the semi-axes of the inner boundary are equal to 0.05 m and 0.1 m in the ˆx and ˆy directions, respectively, while those of the outer boundary are given by 0.1 m and 0.2 m, respectively. The values of the appropriate cloak material parameters used in this simulation were taken from D.-H. I(won and D. H. Werner, Appl. Phys. Lett. 92, 013505 (2008).

The radiation pattern and the input impedance or admittance of an antenna are fundamental figures of merit when assessing radiation and circuit characteristics of the antenna. For 2D antennas, the directivity $D_{2D}$ can be defined similar to that for 3D antennas as:

$$D_{2D} = \frac{S(\phi)}{S_{av}};\ S(\phi) = Z_0|H_z(\phi)|^2, \tag{1}$$

where $Z_0$ is the intrinsic impedance of free space and $S(\phi)$ is the magnitude of the complex Poynting vector in the radial direction corresponding to $\phi$. $S_{av}$ is the average value of $S(\phi)$ with respect to the angle $\phi$ measured from the $+\hat{x}$ direction.

Figure 3:
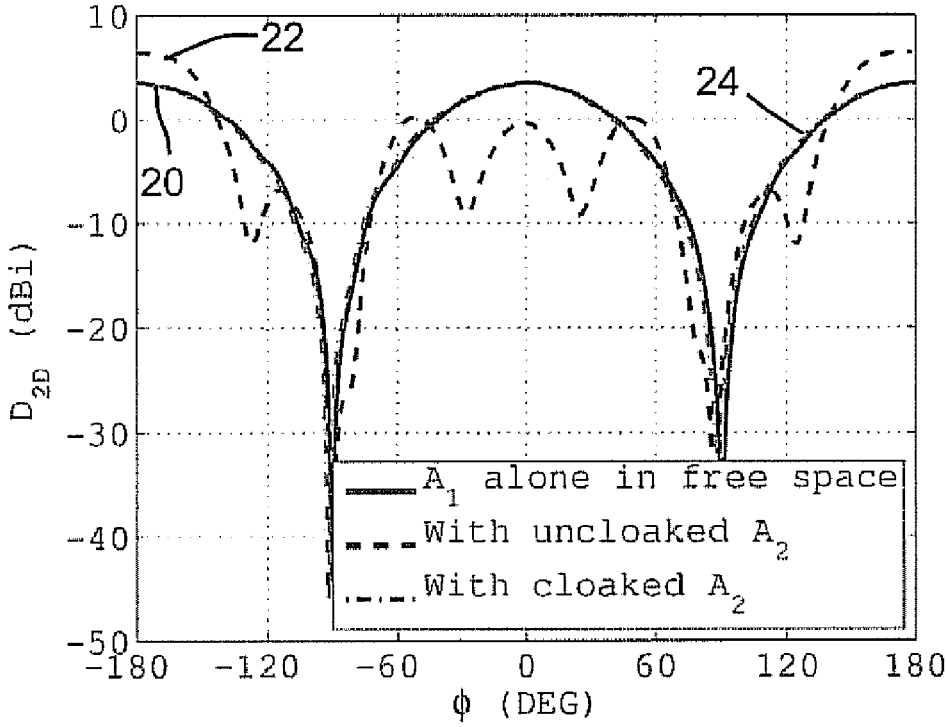
FIG. 3 shows the far-field directivity patterns produced by antenna $A_1$ operating at 2 GHz for $A_1$ radiating alone in free space, $A_1$ radiating in the presence of the uncloaked $A_2$ located a distance of 200 mm away from $A_1$, and $A_1$ radiating in the presence of the cloaked $A_2$.

FIG. 3 shows the values of $D_{2D}$ at 2 GHz due to the radiation by $A_1$ as a function of $\phi$ for the scenarios depicted in FIGS. 2B and 2C. Similar to three dimensional straight wire dipoles, the line-dipole antenna has a pattern null in the direction along the dipole axis. The strongest radiation produced by $A_1$ (with an associated directivity of 3.6 dBi) is in the ±ˆx direction, which is normal to the axis of the antenna. Curve 20 shows the free space radiation directivity pattern.

When $A_1$ radiates in the presence of an uncloaked antenna $A_2$, located 200 mm away, the directivity pattern is distorted, as shown previously in FIG. 2B. As shown by dashed curve 22, the maximum directivity increases to 6.46 dBi at $\phi$=180° and decreases to 0.32 dBi at $\phi$=0°.

However, when $A_2$ is enclosed by $C_2$ (as illustrated by FIG. 2C), the directivity pattern 24 is restored to that of Al radiating alone in free space. Curve 24 is essentially identical to the free space curve shown at 20.

Figure 4:
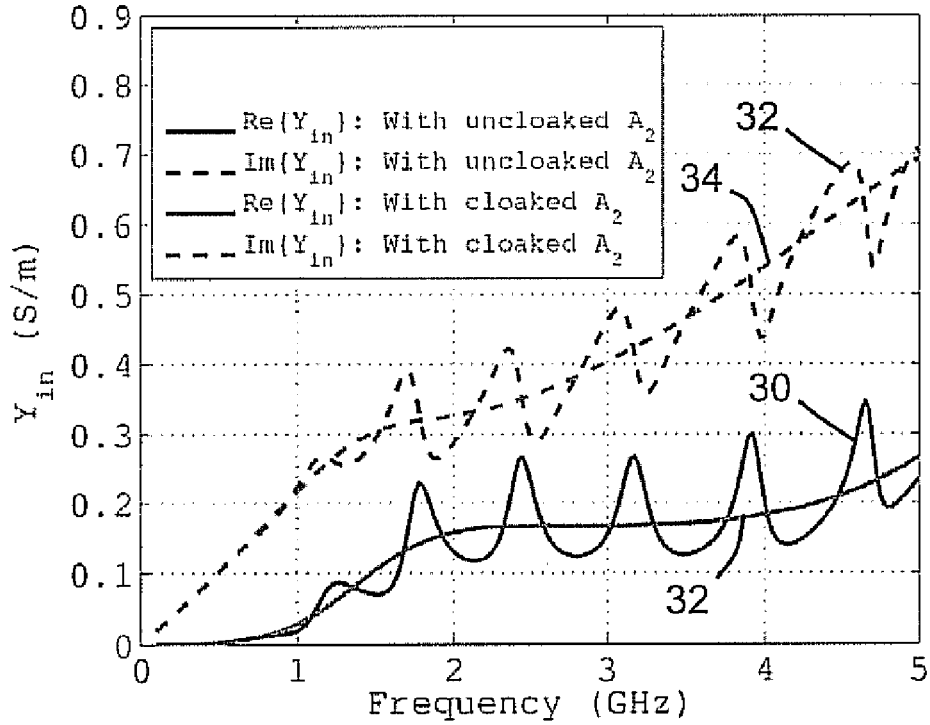
FIG. 4 shows the input admittance per unit length of $A_1$ for the radiation scenarios shown in FIGS. 2B and 2C.

FIG. 4 illustrates the effects on the circuit parameters of the antenna for the three scenarios considered in FIGS. 2A-2C. Since the antenna is 2D (i.e., infinite in the ±ˆz directions), the circuit parameter considered in this case is the input admittance per unit length, denoted $Y_{in}$. The accuracy of $Y_{in}$ obtained from the finite-element simulations was verified by comparing the results with those obtained from another full-wave analysis technique based on the method of moments for the reference configuration depicted in FIG. 2A.

The values of $Y_{in}$ measured at the input terminals of $A_1$ are compared as a function of frequency, where an exp(jωt) time convention is assumed. The input admittance of an electrically thin line dipole antenna in free space does not oscillate between capacitive and inductive states with respect to frequency as 3D wire antennas do. Instead, the antenna remains capacitive over the entire frequency window of observation.

When $A_1$ radiates in the presence of the uncloaked antenna $A_2$, the admittance curves are seen to oscillate around the cloaked curves. FIG. 4 shows curves 30 and 32 (the real and imaginary parts of the admittance, respectively) having oscillatory deviations from free space behavior as a function of frequency in the presence of the uncloaked proximate second antenna. This corresponds to the configuration of FIG. 2B. Curves 32 and 34 are the corresponding curves when the second antenna is cloaked, corresponding to FIG. 2C. In this case, the curves closely approximate the free space curves, and are indistinguishable in this graphical plot.

Near-field mutual coupling effects are responsible for the deviations shown in curves 30 and 32. Enclosing $A_2$ by the cloak $C_2$ restores the input admittance of $A_1$ to that of the unperturbed case of radiation in a free space environment. Therefore, the antenna $A_1$, as it was originally designed for radiation in free space, does not need to be re-designed or re-tuned for operation in a multi-antenna environment. This can improve performance predictability, simplifies design, and lowers cost of an improved antenna system according to an example of the present invention.

Cloaking of Other Objects

Examples of the present invention include applications of electromagnetic cloaks to shielding the radiation and circuit parameter characteristics of an antenna from other objects and other antennas in highly scattering environments.

For an antenna radiating on a large platform or in close proximity to a large scattering object, an electromagnetic cloak designed to operate at the transmitting frequency of the antenna can remove any scattering caused by a nearby object. This may be visualized by replacing $A_2$ in FIG. 1 by a scatterer of arbitrary size and shape, which may have a significant loading effect on the radiation and circuit parameters of $A_1$. Enclosing the scatterer with $C_2$ will ensure that the electrical performance parameters of $A_1$ are preserved regardless of whether the scatterer is in the near or far zone of $A_1$.

Figure 5A:
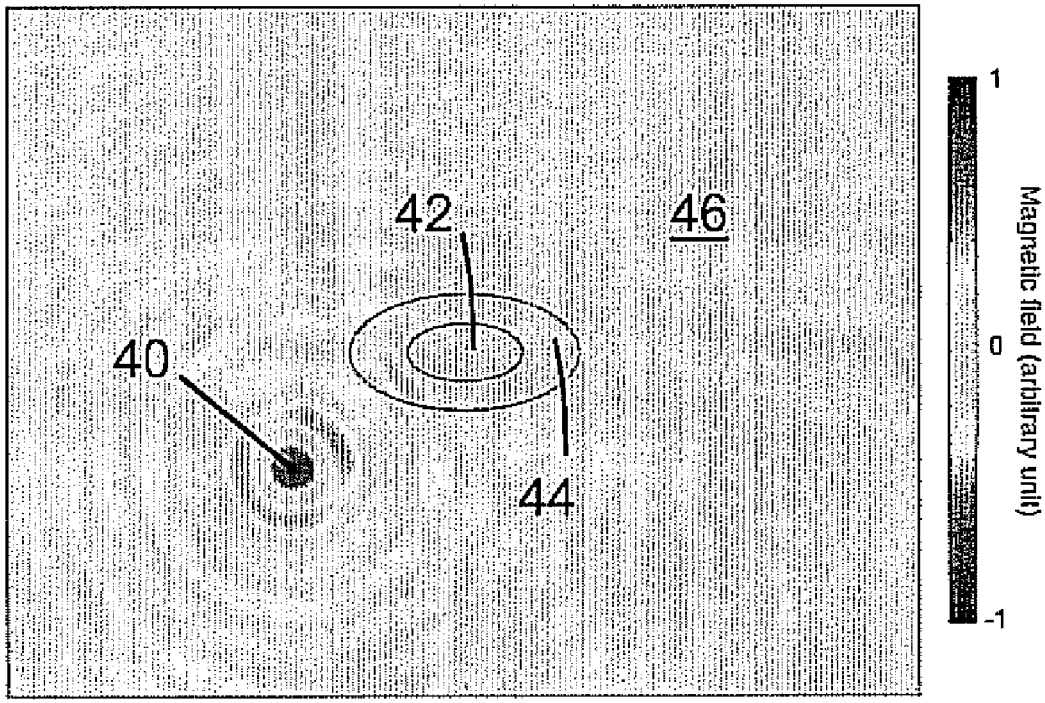
FIGS. 5A and 5B show total magnetic field distribution for an antenna near an uncloaked and cloaked scatterer, respectively.
Figure 5B:
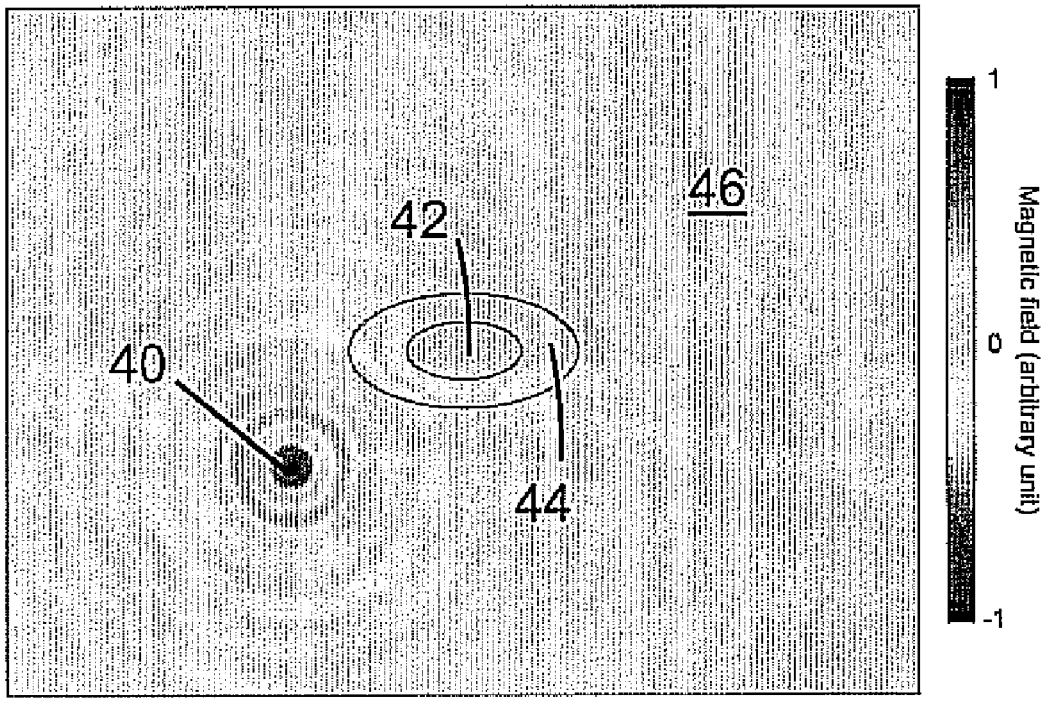

FIGS. 5A-5B show an example antenna radiating close to an uncloaked and cloaked scatterer respectively, where snapshots of the total z-directed electric field distributions are shown. The figures show total magnetic field distribution with an electric line source radiating near a cloaked PEC (perfect electrical conductor) cylinder. In FIG. 5A, the scatterer is directly exposed to the incoming radiation from antenna $A_1$, and in FIG. 5B, the cylinder is cloaked. The inner and the outer boundaries of the cloak are shown by black contours. The inner contour coincides with the boundary of the PEC scatterer.

As simulated in FIGS. 5A-5B, an electric line source located at (x,z)=(−0.3 m,−0.2 m) radiates cylindrical incident waves. An elliptic cylinder having its center located at the coordinate origin has its semi-axes in the x and y axis directions equal to $x_1$=0.1 m and $y_1$=0.05 m. When the PEC scatterer is directly exposed (i.e., with no cloak present) to the incoming cylindrical wave as depicted in FIG. 1B, the PEC cylinder creates scattering. Most notably, a shadow is cast in the forward scattering direction.

However, when the scatterer is covered with an electromagnetic cloak, the incident wave is guided around the object and proceeds as if it passed through free space as shown in FIG. 5B. The cloak conceals the scatterer even though the object is not in the far field of the source.

Hence, when a scatterer is covered with a cloak that operates at $f_k$, the scatterer will be effectively invisible to any observer outside the cloak so that it will not create any interference to any source operating at the same frequency $f_k$. Furthermore, cloaked scatterers may be placed not only in the far field of an antenna but also in the near field as well without creating any interference or coupling effects.

When the scatterer is covered with an electromagnetic cloak, the incident wave is guided around the object and proceeds as if it passed through free space. In practical applications, the PEC scatterer may represent an electrically large scattering object in the vicinity of the source blocking the radiated field from reaching its back side. Regardless of the electrical size or the distance from the source, a scatterer covered by a properly-designed electromagnetic cloak will not interfere with radiation from a nearby antenna.

Examples of the present invention include methods and apparatus for reducing the effects of objects (including scatters and other antennas) on antenna performance. In some examples, an antenna performance approximating that of the antenna in free space may be attained, even in multiple antenna systems or otherwise highly scattering environments.

Cloaks

Cloaks may take the form of improved radomes, coatings, or other forms. A cloak may conform to the surface of a cloaked object, or may enclose one or more cloaked objects within an interior space which need not conform to any object therein. Cloaks may be spherical, spheroidal, hemispherical, otherwise dome shaped, may be prolate or oblate spheres or sections thereof, or may be an arbitrary shape depending on space or manufacturing considerations.

A cloak may be multi-band, or a plurality of cloaks provided at different bands. For example, nested spheres, cylinders, and the like may be provided to provide multi-band cloaking.

A cloak may be an arbitrary shape, and does not necessarily conform to an object such as an antenna or other scatterer contained within. Cloaks may be cylindrical, spherical, hemispherical, or other shape. The shape of the cloak may be influenced by practical limitations related to the cloaking material used. For example, the cloak may be a metamaterial comprising repeated conducting patterns printed on a rigid or flexible substrate.

A cloak may comprise a metamaterial, for example an artificially structured composite comprising conducting elements (such as metal elements) and a dielectric support material. A metamaterial can be configured to have a negative refractive index at a frequency of operation as a cloak.

Applications

In multiple-antenna radiation environments, each antenna can be enclosed in an electromagnetic cloak, designed to operate at the frequencies of other antennas, with the cloak becoming transparent (non-operative as a cloak) at the operating frequency of the enclosed antenna.

It was shown that interferences on the input parameters, near-field interactions, and the far-field radiation patterns of an antenna can be essentially completely removed by shielding individual antennas in a multi-antenna radiation environment using electromagnetic cloaks. Each antenna can achieve the same electrical performance characteristics as if it were radiating in free space.

Applications of the present invention also include the improvement of antenna reception, as well as antenna transmission properties. The effect of an object (such as an antenna, antenna support (such as a tower), or other scattering structure) on the reception at a particular frequency band may be reduced by providing one or more cloaks on the object functional at the particular band. For example, television reception near a cellphone tower can be improved by providing the cellphone tower with a cloak operable at the television frequencies. Cellphone reception near a radio antenna may be improved by enclosing the radio antenna within a cloak operable at the cellphone band. Radio reception near a GPS or other device or object may be improved by providing a cloak operable at a radio frequency of interest.

Applications include reducing the effects of proximate objects on the parameters of an antenna, where the objects may be other antennas, other scatterers, or any object that would have a discernable influence on the antenna properties if the object were not cloaked.

A cloaked antenna may be a transmitting antenna and/or a receiving antenna. Similarly, an antenna whose properties are improved by cloaking of nearby objects (such as a proximate antenna) may be a transmitting antenna and/or receiving antenna, and may be cloaked or uncloaked as required.

An electronic device, such as a radio, GPS, computer, personal digital assistant, media player, cell-phone, or multi-functional device having one or more functions such as mentioned above, may include one or more antennas or scatterers cloaked according to an example of the present invention. Wireless network coverage may be improved by cloaking of scatterers and antennas within the network area. Applications include further include marine applications (such as ship-mounted antenna systems), avionic systems, and the like.

Multifunctional electronic devices may receive multiple electromagnetic radiation bands, such as radio, cellphone, and GPS signals. The performance of any antenna may be improved by cloaks on other antennas or other scatterers operable at the antenna band. Antenna performance may be improved by cloaking the support structure of the antenna, and of a second antenna nearby.

Patents, patent applications, or publications mentioned in this specification are incorporated herein by reference to the same extent as if each individual document was specifically and individually indicated to be incorporated by reference. In particular, U.S. Provisional Patent Application Ser. No. 61/026,880, filed Feb. 7, 2008, is incorporated herein by reference.

The invention is not restricted to the illustrative examples described above. Examples described are exemplary, and are not intended to limit the scope of the invention. Changes therein, other combinations of elements, and other uses will occur to those skilled in the art. The scope of the invention is defined by the scope of the claims.

Having described our invention, we claim:

1. An apparatus, the apparatus comprising:

an antenna, having an operating frequency; and an electromagnetic cloak disposed around the antenna, the electromagnetic cloak having a cloaking frequency range in which the electromagnetic cloak is operative to guide external radiation around the antenna, the electromagnetic cloak being substantially transparent at the operating frequency, the electromagnetic cloak including a metamaterial;

the antenna being a first antenna, the electromagnetic cloak being a first electromagnetic cloak, the apparatus further comprising:

a second antenna having a second operating frequency, and a second electromagnetic cloak disposed around the second antenna, the second operating frequency being within the cloaking frequency range of the first electromagnetic cloak, the second electromagnetic cloak being substantially transparent at the second operating frequency, the second electromagnetic cloak including a metamaterial.

2. The apparatus of claim 1, the first electromagnetic cloak being substantially transparent at the operating frequency of the first antenna, and operable to guide radiation at the second operating frequency around the first antenna, the second electromagnetic cloak being substantially transparent at the second operating frequency, and operable to guide radiation at the operating frequency of the first antenna around the second antenna.

3. The apparatus of claim 2, the second electromagnetic cloak having a second cloaking frequency range, the second cloaking frequency range including the operating frequency of the first antenna.

4. The apparatus of claim 1, the electromagnetic cloak being disposed so that most radiation transmitted or received by the antenna passes through the electromagnetic cloak.

5. The apparatus of claim 1, the electromagnetic cloak being disposed so that substantially all radiation transmitted or received by the antenna passes through the electromagnetic cloak.

6. The apparatus of claim 1, the antenna including a dipole element extending along a direction of elongation, the electromagnetic cloak also being elongated along the direction of elongation.

7. The apparatus of claim 1, the apparatus being an antenna array including a plurality of antennas, each antenna having an individual operating frequency and an associated electromagnetic cloak that is substantially transparent at the individual operating frequency.

8. The apparatus of claim 1, the apparatus further including a conducting structure, the conducting structure being enclosed in an electromagnetic cloak at the operating frequency.

9. The apparatus of claim 8, the conducting structure being a mount for the antenna.

10. An apparatus, the apparatus comprising:

a first antenna having a first operating frequency;

a first cloak surrounding the first antenna, the first cloak having a first frequency range in which the first cloak is operative;

a second antenna having a second operating frequency; and a second cloak surrounding the second antenna, the second cloak having a second frequency range in which the second cloak is operative, the first operating frequency being within the second frequency range, the second operating frequency being within the first frequency range, the first cloak being a first electromagnetic cloak operable to guide electromagnetic radiation around the first antenna, the second cloak being a second electromagnetic cloak operable to guide electromagnetic radiation around the second antenna, the first cloak being substantially transparent at the first operating frequency, the second cloak being substantially transparent at the second operating frequency, the first cloak and the second cloak each including a metamaterial.

11. The apparatus of claim 10, the first antenna's operating frequency being outside the first cloak's frequency range, and the second antenna's operating frequency being outside the second cloak's frequency range.

12. The apparatus of claim 10, further including at least one antenna mounting structure having an electromagnetic cloak.

13. A method of reducing electrical interactions between a first antenna having a first operating frequency and a second antenna having a second operating frequency, the method comprising:

providing a first electromagnetic cloak being disposed around the first antenna; and providing a second electromagnetic cloak being disposed around the second antenna, so as to reduce the electrical interactions, the first electromagnetic cloak being substantially transparent at the first operating frequency, and operable to guide radiation at the second operating frequency around the first antenna, the second electromagnetic cloak being substantially transparent at the second operating frequency, and operable to guide radiation at the first operating frequency around the second antenna, the first electromagnetic cloak and the second electromagnetic cloak each including a metamaterial.

* * * * *